US006870321B2

(12) United States Patent
Schartner et al.

(10) Patent No.: US 6,870,321 B2
(45) Date of Patent: Mar. 22, 2005

(54) HIGH-FREQUENCY ELECTRON SOURCE

(75) Inventors: Karl-Heinz Schartner, Giessen (DE); Horst Loeb, Giessen (DE); Hans Juergen Leiter, Freising (DE); Hans-Peter Harmann, Wettenberg (DE)

(73) Assignee: Astrium GmbH, Munich (DE)

( * ) Notice: Subject to any disclaimer, the term of this patent is extended or adjusted under 35 U.S.C. 154(b) by 60 days.

(21) Appl. No.: 10/410,674

(22) Filed: Apr. 9, 2003

(65) Prior Publication Data

US 2003/0209961 A1 Nov. 13, 2003

(30) Foreign Application Priority Data

Apr. 9, 2002 (DE) ..... 102 15 660

(51) Int. Cl.[7] ..... H01J 7/24

(52) U.S. Cl. ..... 315/111.31; 315/111.21; 250/281; 250/283; 118/723 VE; 118/723 R

(58) Field of Search ..... 315/111.31, 111.21, 315/111.81, 111.71; 250/281, 283, 285, 382, 385.1; 118/723 VE, 723 R, 733, 723

(56) References Cited

U.S. PATENT DOCUMENTS 4,335,465 A 6/1982 Christiansen et al. ..... 376/156
4,473,736 A 9/1984 Bloyet et al. ..... 219/121
4,684,848 A 8/1987 Kaufman et al. ..... 315/111.81
4,954,751 A 9/1990 Kaufman et al. ..... 315/111.81
5,003,226 A 3/1991 McGeoch ..... 315/111.81
5,198,718 A 3/1993 Davis et al. ..... 313/359.1
5,804,027 A * 9/1998 Uchida ..... 156/345.49
6,291,940 B1 9/2001 Scholte Van Mast ... 315/111.81
6,335,595 B1 * 1/2002 Nishikawa et al. ..... 315/111.21

FOREIGN PATENT DOCUMENTS

JP 62185324 8/1987

* cited by examiner

*Primary Examiner*—Tuyet Thi Vo
(74) *Attorney, Agent, or Firm*—Davidson, Davidson & Kappel, LLC

(57) ABSTRACT

A high-frequency electron source includes a discharge chamber having at least one gas inlet for a gas to be ionized and at least one extraction opening for electrons. The high-frequency electron source also includes a first electrode at least partially surrounding the discharge chamber and a keeper electrode at least partially surround the discharge chamber. The first electrode and the keeper electrode are configured to provide a high-frequency electric field therebetween.

30 Claims, 2 Drawing Sheets

HIGH-FREQUENCY ELECTRON SOURCE

Priority is claimed to German Patent Application DE 102 15 660.3, filed on Apr. 9, 2002, which is incorporated by reference herein.

BACKGROUND

The present invention relates to a high-frequency electron source, in particular in the form of an ion source neutralizer, in particular for an ion thruster, including a discharge chamber having at least one gas inlet for a gas to be ionized and at least one extraction opening for electrons.

In all applications where accelerated, electrically charged particles are needed—which is the case, for example, in surface treatment—ion beams must be neutralized after acceleration. Thus, aerospace engineers increasingly use electric propulsion units to propel satellites or space probes after they separate from the carrier rockets. Electric propulsion units are already being used today, especially for station-keeping of geostationary communications satellites. Ion propulsion units and SPT plasma propulsion units are mainly used for this purpose. Both types generate their thrust by ejecting accelerated ions. However, the ion beam must be neutralized to avoid charging the satellite.

The electrons needed to do this are provided from an electron source and incorporated into the ion beam through plasma coupling.

Up to now, aerospace engineers have used hollow-cathode plasma bridge neutralizers having electron emitters to neutralize these electric propulsion units (ion propulsion units and SPT plasma propulsion units). The neutralizer includes a cathode tube, which is terminated in the flow direction by a cathode disk having a central hole, and an anode disk that also has a central hole. An electron emitter, whose porous material is permeated by alkaline earth metals, including barium, is located inside the cathode tube. A coil-shaped electric heating element that heats the cathode tube and electron emitter is mounted on the outside of the cathode tube. The barium contained in the electron emitter emits electrons. A voltage applied between the anode disk and cathode disk accelerates these electrons. When a neutral gas, such as xenon, passes through the cathode tube, the electrons collide with the neutral gas atoms and ionize them, forming a plasma that is discharged through the hole in the anode disk.

A disadvantage of this system is that the emitter material contained in the electron emitter is hygroscopic and also reacts with oxygen at elevated temperatures. Consequently, this greatly limits its ability to be stored before installation, during mounting on the satellite and during commissioning prior to space launch. A further disadvantage of such complex and short-lived electron sources is that the emitter must be preheated for several minutes prior to activation.

An ion source neutralizer that includes a plasma chamber having walls made of a dielectric material and surrounded by a high-frequency coil is also known from U.S. Pat. No. 5,198,718.

A high-frequency electron source of this type generates electrons through a plasma that is produced through induction and maintained by a magnetic alternating field. This field is created by the high-frequency coil through which a high-frequency current flows. The electrons present in the plasma are accelerated by induction to speeds that, upon collision with a neutral atom in the plasma, can cause ionization thereof. During ionization, one or more further electrons are detached from the neutral atom, producing a continuous electron flow in the working gas jet.

The disadvantage of an electron source of this type is that a large portion of the energy needed to maintain the plasma in the plasma chamber is lost by the high-energy electrons from the plasma striking the chamber wall and thus being rebound to atoms. Through this process, not only are these electrons lost, but a large portion of the energy gained by the electrons through the alternating field is also dissipated. In addition, the high-frequency coil in the plasma chamber wall induces a ring current (eddy current), causing loss of energy that cannot be discharged to the plasma.

SUMMARY OF THE INVENTION

An object of the present invention is to provide a high-frequency electron source that does not include an electron emitter, thereby eliminating the need for a heating phase, and also does not require any complex, cost-intensive structural components that need to be protected against oxygen and moisture. It is also intended to provide a more energy-efficient electron source.

According to the present invention, the discharge chamber is partially surrounded with at least one electrode and one keeper electrode and a high-frequency electric field is provided between the electrodes. The high-frequency electron source that uses a cold arc discharge process in which the plasma supplying the electrons is generated by a capacitive high-frequency discharge that is produced in the discharge chamber by an electric high-frequency field between the electrodes. For the purposes of the present invention, it is not necessary for the electrodes to surround the discharge chamber and form a cavity. They need only to be suitable for igniting and maintaining the plasma in the discharge chamber.

The present invention provides a high-frequency electron source (10), in particular in the form of an ion source neutralizer, in particular for an ion thruster, comprising a discharge chamber (11) having at least one gas inlet (14) for a gas to be ionized and at least one extraction opening (16) for electrons, wherein the discharge chamber (11) is at least partially surrounded by at least one electrode **(12*a*) and one keeper electrode (12*b*)**, and a high-frequency electric field is provided between the electrodes.

The discharge of the high-frequency electron source is ignitable by a sudden pressure change, which may be produced, for example, by briefly increasing the mass flow through the electron source. This minimizes the ignition voltage on the Paschen curve, and the gas begins to flow. The accelerated electrons, in turn, then strike additional electrons from neutral particles and ionize them. This advancing ionization state generates a plasma that supplies the necessary electrons.

Advantages of the high-frequency electron source include its simple, uncomplicated construction. Thus, there is no need for a heating system, electronics or electron emitter, which also eliminates the storage restrictions and limitations on environmental conditions during assembly and operation. For example, it is possible to carry out a serviceability test under normal environmental conditions after manufacture without impairing the service life of the high-frequency electron source. It is also possible to use inert gases such as xenon, or other suitable gases that do not have to be specially purified to remove oxygen and residual moisture. The elimination of the preheating phase and activation processes also makes the electrons quickly available so that, when neutralizing an ion thruster, the latter is able to provide its thrust immediately.

Because relatively low-frequency operation of the high-frequency electron source is possible, high electric efficiency levels are achievable on the electronics side. In addition, the high-frequency electron source according to the present invention is very energy-efficient.

The discharge chamber is preferably surrounded by a plasma chamber. This minimizes possible gas losses. In particular, an electrode is designed so that it forms the plasma chamber.

If an electrode forms the plasma chamber, it is preferably designed as a hollow cathode. In addition to forming an optimal geometry for enclosing the plasma, a geometry of this type supports capacitive incorporation of the high-frequency field into the plasma.

The high-frequency electric field may have any orientation relative to the direction of electron extraction; however, the high-frequency electric field preferably lies parallel to the direction of extraction. According to an alternative, preferred embodiment, the field may also be positioned perpendicularly to the direction of extraction.

Because no resonance effects need to be utilized, a wide range of discharge frequencies is selectable, making it possible to effectively adapt them to the requirements. However, the frequency of the high-frequency electric field preferably lies between 100 KHz and 50 MHz.

To generate the high-frequency electric field, a high-frequency generator (HF generator) is advantageously inserted between the electrode and keeper electrode—a radio-frequency generator (RF generator) is especially advantageous for this purpose—the connection to the electrodes being established via a matching network. In particular, the matching network is a toroidal core transformer. A design of this type makes it possible to optimally adjust the field strength of the high-frequency electric field to the discharge conditions.

In using a system in which the plasma chamber is designed as an electrode, it has proven to be advantageous to connect the keeper electrode to the active output of the HF generator and set the electrode to frame potential.

For the purposes of electric shielding from the environment, it is advantageous for the electrode and keeper electrode to be surrounded by a shield electrode.

According to another preferred embodiment, the electrode is connected to the active output of the HF generator, and the keeper electrode is set to frame potential. In this case, it is not necessary to provide the shield electrode.

To increase the efficiency of the high-frequency electron source, d.c. voltage may be applied between the electrodes in addition to applying the high-frequency electric field. This makes it easier for the plasma electrons to exit the electron source.

According to an alternative embodiment, the d.c. voltage may, however, be applied across the auxiliary electrodes, for which purpose the latter are grouped around the discharge chamber.

The electrodes may be made in principle of any suitable material that meets the requirements of an electron source of this type. and its particular area of application. However, electrodes made of a metallic material such as titanium, molybdenum, tungsten, steel, special stainless steel or even aluminum or tantalum are preferred. Possible non-metallic materials include, in particular, graphite, carbon compound materials or conductive ceramics.

BRIEF DESCRIPTION OF THE DRAWINGS

The present invention is explained in greater detail below on the basis of two exemplary embodiments illustrated in the drawings, in which.

DETAILED DESCRIPTION

Figure 1:
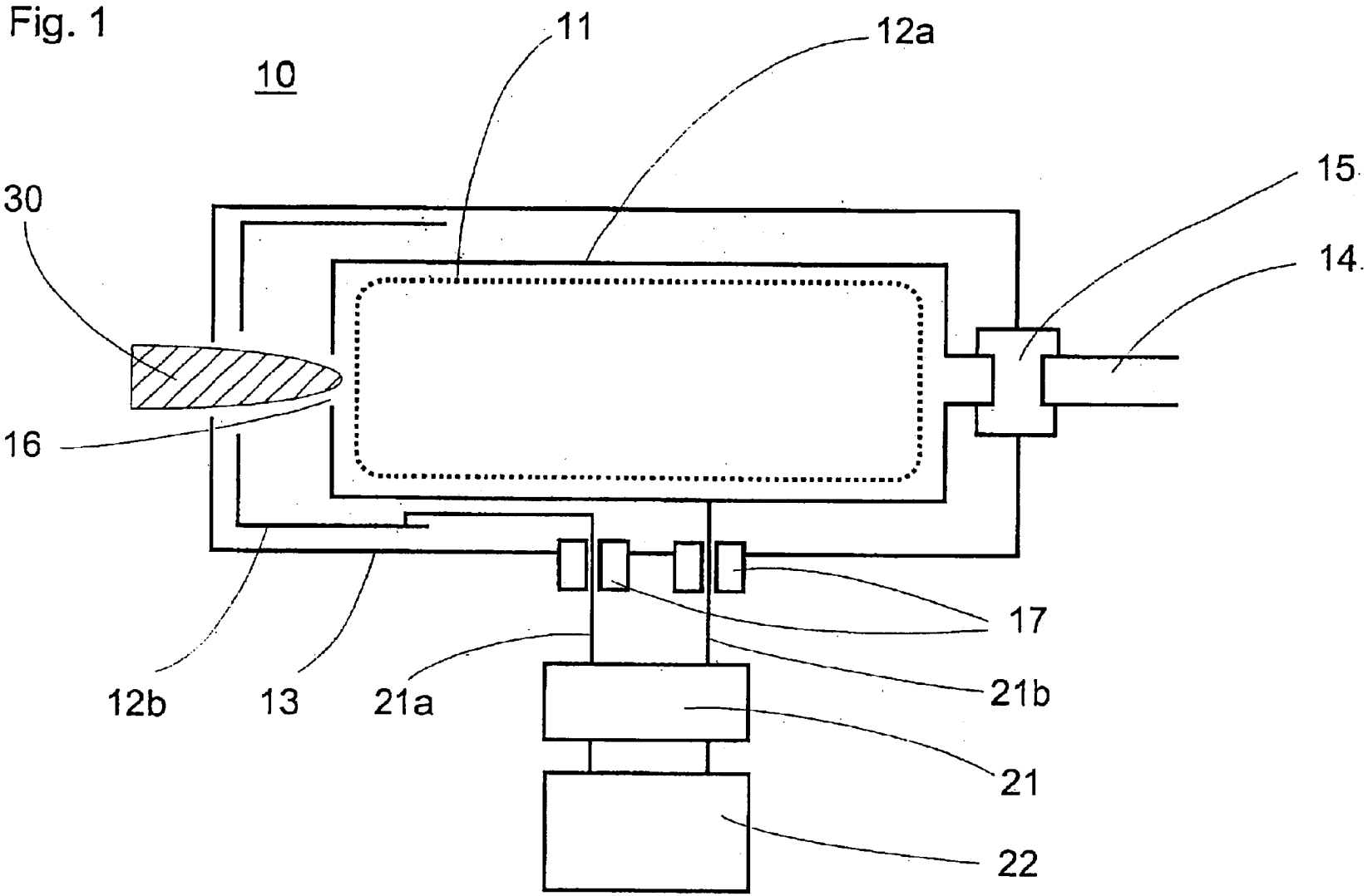
FIG. 1 shows a schematic construction of the high-frequency electron source according to the present invention in an embodiment having a plasma chamber designed as a hollow cathode and a shield electrode.

FIG. 1 shows high-frequency electron source 10, which includes an electrode 12*a* that forms a plasma chamber designed as a hollow cathode and surrounds discharge chamber 11. The latter has a circular cross-section and, on one side, a gas inlet 14 for the operating gas to be ionized, for example, xenon. Extraction opening 16 for discharging the plasma, including the electrons, is provided coaxially at the opposite end of the plasma chamber. Electrode 12*a* designed as the plasma chamber is partially surrounded by keeper electrode 12*b*. The latter is additionally surrounded by a shield electrode 13. Keeper electrode 12*b* and shield electrode 13 also have an opening, positioned coaxially to extraction opening 16 at the plasma chamber, enabling the plasma and electrons to be discharged. Gas inlet 14 passes through shield electrode 13 to allow the shield electrode to completely surround plasma chamber 12*a*. For electric insulation purposes, gas inlet 14 is electrically insulated from electrodes 12*a*, 13 by an insulator 15.

The conductive areas, in particular electrode 12*a* designed as the plasma chamber, should meet certain conditions in addition to performing their primary function of ensuring electrostatic confinement of the electrons. Not only should they resist the plasma to survive the necessary operating time without an excessive loss of quality, but they should not prevent the high-frequency electric field from being incorporated and thus the plasma from being maintained. Ions continuously strike electrode 12*a* during operation, thus causing erosion. The temperature of the high-frequency electron source may also range between 300° and 400° C.

Aerospace engineering applications additionally impose relatively strict requirements on a high-frequency electron source. Therefore, to use the high-frequency electron source as a neutralizer for ion propulsion units in aerospace engineering, operating times between 8,000 and 15,000 hours must currently be guaranteed. In addition, the high-frequency electron source is operated in a high vacuum, which means that the material should have a low vapor pressure point to avoid outgassing. Finally, the high-frequency electron source should withstand launch loads when transporting equipment having a high-frequency electron source of this type into space. In this regard, there are a number of metallic and non-metallic materials in particular that meet these requirements, which is why the conductive areas, in particular electrode 12*a*, are preferably made of titanium, molybdenum, tungsten, steel, aluminum, tantalum, graphite, conductive ceramic or carbon compound materials.

To generate a high-frequency electric field having a frequency, for example, of 1 MHz to produce a plasma, electrode 12*a* and keeper electrode 12*b* are activated by a radio frequency generator 22, which is connected by a toroidal core transformer 21 to electrodes 12*a*, 12*b* via feed lines 21*a*, 21*b*. Feed line 21*a*, and thus plasma chamber 12*a*, is therefore set to frame potential, while feed line 21*b*, and thus keeper electrode 12*b*, is connected to the active output of the radio frequency network. Because no resonance effects are utilized, a wide range of discharge frequencies is selectable, making it possible to set values between 100 KHz and 50 MHz in addition to 1 MHz. In addition to the high-frequency electric field, a d.c. voltage is also applied to keeper electrode 12*b* via feed line 21*b*. This makes it easier for the electrons to exit the discharge plasma, thus improving the efficiency of the electron source. To ensure electric insulation between the different electrodes, feed lines 21*a*, 21*b* are shielded by additional insulators 17 from shield electrode 13 and keeper electrode 12*b*, respectively.

To ignite the plasma, operating gas xenon flows through gas inlet 14 into discharge chamber 10. The high-frequency electric field is present between electrode 12*a* designed as the plasma chamber and keeper electrode 12*b*. This field is capacitively incorporated into discharge chamber 11. The small number of free electrons present in thermal equilibrium in the working gas are thereby accelerated and thus ionize the operating gas by impact in the presence of sufficient energy from the high-frequency electric field. This ionization, in turn, generates secondary electrons that participate in the process. An electron avalanche is thus produced, ultimately resulting in the plasma. However, the plasma in discharge chamber 11 is not in thermal equilibrium, since nearly all the energy of the high-frequency electric field is absorbed by the plasma electrons, which take in more energy than do the ions because their mass is lower than that of the ions. As a result, the electron temperature is higher than the temperature of the ion and neutral particles by a factor of 100.

The xenon gas jet exits to the outside through extraction opening 16. In the present embodiment, it is designed as supersonic jet 30. Gas jet 30 thus transports the high-frequency plasma to the outside. There it may be used as an electron source for firing a propulsion unit or as a bridge for incorporating the electrons into the ion beam. Continuous delivery of new operating gas via the gas inlet continuously replenishes the gas to be ionized, so that the system remains in equilibrium even though a portion of the plasma is removed.

Figure 2:
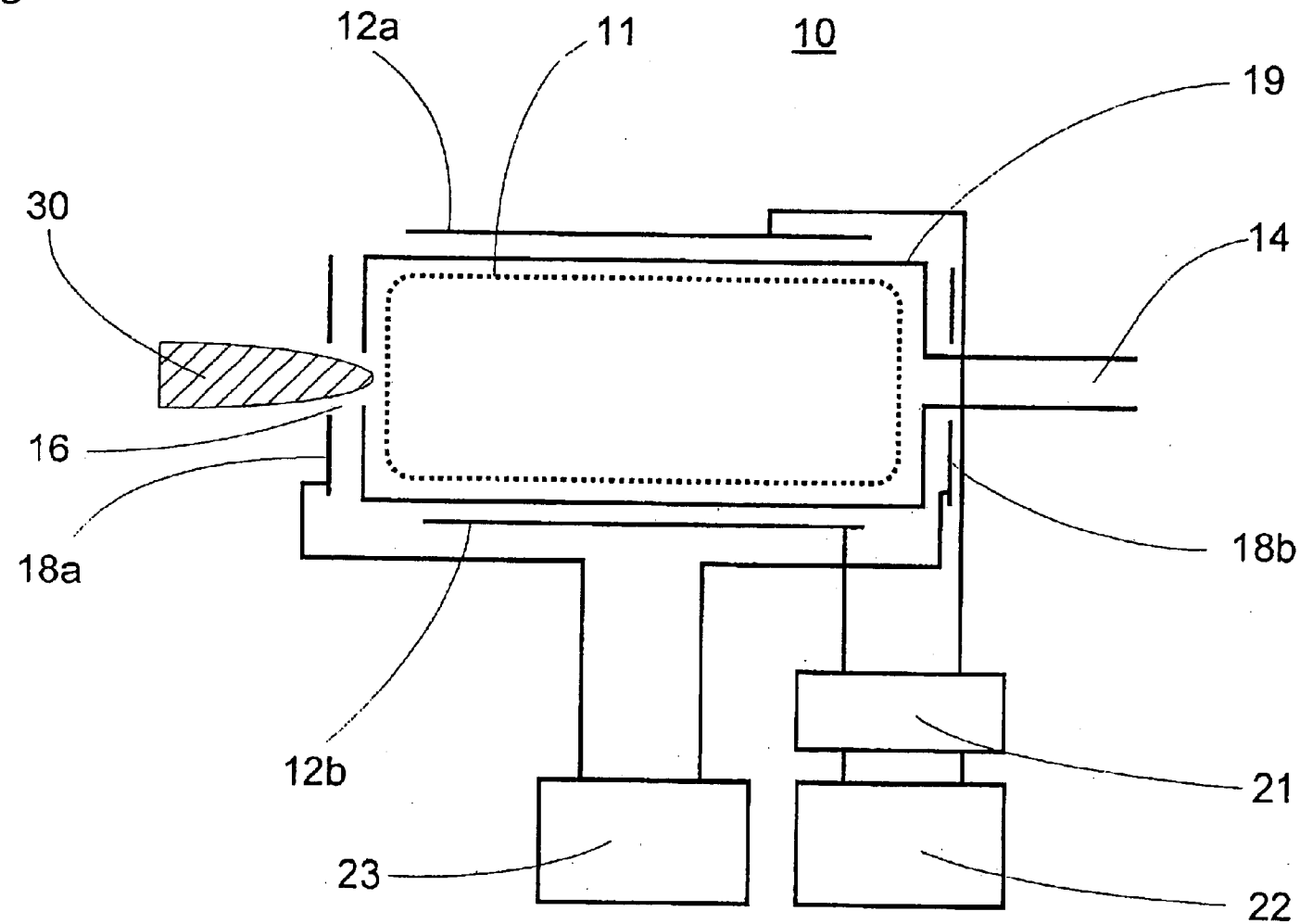
FIG. 2 shows a schematic construction of an embodiment having a plasma chamber that is electrically insulated against the electrodes.

FIG. 2 shows high-frequency electron source 10 having electrodes 12*a* and 12*b*, between which an electric alternating field is provided. The alternating field is positioned perpendicularly to the extraction direction of the electrons, which are discharged by a plasma jet 30. The discharge chamber is terminated and electrically insulated against electrodes 12*a* and 12*b* by a dielectric discharge chamber 19. To support extraction, a d.c. voltage that is generated by power supply 23 is applied between auxiliary electrodes 18*a* and 18*b*, which are electrically insulated against each other.

What is claimed is:

1. A high-frequency electron source, comprising:

a discharge chamber having at least one gas inlet for a gas to be ionized and at least one extraction opening for electrons;

a first electrode at least partially surrounding the discharge chamber;

a keeper electrode at least partially surround the discharge chamber, wherein the first electrode and the keeper electrode are configured to provide a high-frequency electric field therebetween; and first and second auxiliary electrodes mounted on the discharge chamber and configured to provide d.c. voltage between the first and second auxiliary electrodes.

2. The high-frequency electron source as recited in claim 1, further comprising a plasma chamber surrounding the discharge chamber.

3. The high-frequency electron source as recited in claim 1, wherein the high-frequency electric field is provided parallel to a direction of electron extraction.

4. The high-frequency electron source as recited in claim 1, wherein the high-frequency electric field is provided perpendicular to a direction of electron extraction.

5. The high-frequency electron source as recited in claim 1, wherein the high-frequency electric field has a frequency between 100 KHz and 50 MHz.

6. The high-frequency electron source as recited in claim 1, wherein the first electrode and the second electrode are further configured to provide a d.c. voltage therebetween.

7. The high-frequency electron source as recited in claim 1, wherein at least one of the first, keeper, and auxiliary electrodes include a metallic material selected from the group consisting of titanium, molybdenum, tungsten, aluminum, tantalum, and steel.

8. The high-frequency electron source as recited in claim 1, wherein at least one of the first, keeper, and auxiliary electrodes include a non-metallic material selected from the group consisting of a graphite, a carbon compound, and a ceramic.

9. The high-frequency electron source as recited in claim 1, wherein the high-frequency electron source is included in an ion source neutralizer.

10. The high-frequency electron source as recited in claim 1, wherein the high-frequency electron source is included in an ion thruster.

11. The high-frequency electron source as recited in claim 1, wherein the first electrode forms a plasma chamber.

12. The high-frequency electron source as recited in claim 11, wherein the first electrode includes a hollow cathode.

13. The high-frequency electron source as recited in claim 1, further comprising a high-frequency generator for generating the high-frequency electric field provided between the first electrode and the keeper electrode.

14. The high-frequency electron source as recited in claim 13, wherein the first electrode is connected to an active output of the high-frequency generator and the keeper electrode has frame potential.

15. The high-frequency electron source as recited in claim 13, wherein the high-frequency generator includes a radio frequency generator having an adaptation network.

16. The high-frequency electron source as recited in claim 15, wherein the adaptation network includes a toroidal core transformer.

17. The high-frequency electron source as recited in claim 13, wherein the keeper electrode is connected to an active output of the high-frequency generator and the first electrode has frame potential.

18. The high-frequency electron source as recited in claim 17, further comprising a shield electrode surrounding the keeper electrode.

19. A high-frequency electron source, comprising:

a discharge chamber having at least one gas inlet for a gas to be ionized and at least one extraction opening for electrons;

a first electrode at least partially surrounding the discharge chamber and including a hollow cathode; and a keeper electrode at least partially surround the discharge chamber, wherein the first electrode and the keeper electrode are configured to provide a high-frequency electric field therebetween.

20. The high-frequency electron source as recited in claim 19, further comprising a plasma chamber surrounding the discharge chamber.

21. The high-frequency electron source as recited in claim 19, wherein the high-frequency electric field is provided parallel to a direction of electron extraction.

22. The high-frequency electron source as recited in claim 19, wherein the high-frequency electric field is provided perpendicular to a direction of electron extraction.

23. The high-frequency electron source as recited in claim 19, wherein the high-frequency electric field has a frequency between 100 KHz and 50 MHz.

24. A high-frequency electron source, comprising:

a discharge chamber having at least one gas inlet for a gas to be ionized and at least one extraction opening for electrons;

a first electrode at least partially surrounding the discharge chamber;

a keeper electrode at least partially surround the discharge chamber; and a shield electrode surrounding the keeper electrode, wherein the first electrode and the keeper electrode are configured to provide a high-frequency electric field therebetween.

25. The high-frequency electron source as recited in claim 24, further comprising a high-frequency generator for generating the high-frequency electric field provided between the first electrode and the keeper electrode.

26. The high-frequency electron source as recited in claim 24, wherein the high-frequency generator includes a radio frequency generator having an adaptation network.

27. The high-frequency electron source as recited in claim 24, wherein the adaptation network includes a toroidal core transformer.

28. The high-frequency electron source as recited in claim 24, wherein the keeper electrode is connected to an active output of the high-frequency generator and the first electrode has frame potential.

29. The high-frequency electron source as recited in claim 24, wherein the first electrode is connected to an active output of the high-frequency generator and the keeper electrode has frame potential.

30. The high-frequency electron source as recited in claim 24, wherein the first electrode and the second electrode are further configured to provide a d.c. voltage therebetween.

* * * * *